US009260671B2

(12) United States Patent
Shafi et al.

(10) Patent No.: US 9,260,671 B2
(45) Date of Patent: Feb. 16, 2016

(54) PROCESS FOR THE TREATMENT OF HEAVY OILS USING LIGHT HYDROCARBON COMPONENTS AS A DILUENT

(75) Inventors: Raheel Shafi, Dhahran (SA); Esam Z. Hamad, Dhahran (SA); Stephane Cyrille Kressmann, Dhahran (SA); Ali Hussain Alzaid, Dammam (SA)

(73) Assignee: SAUDI ARABIAN OIL COMPANY (SA)

( * ) Notice: Subject to any disclaimer, the term of this patent is extended or adjusted under 35 U.S.C. 154(b) by 881 days.

(21) Appl. No.: 12/502,357

(22) Filed: Jul. 14, 2009

(65) Prior Publication Data

US 2010/0025291 A1 Feb. 4, 2010

Related U.S. Application Data

(60) Provisional application No. 61/080,517, filed on Jul. 14, 2008.

(51) Int. Cl.
*C10G 65/12* (2006.01)

(52) U.S. Cl.
CPC ..... *C10G 65/12* (2013.01); *C10G 2300/202* (2013.01); *C10G 2300/205* (2013.01); *C10G 2300/802* (2013.01)

(58) Field of Classification Search
USPC ..... 208/58, 59, 88, 89, 210–213, 251 R
See application file for complete search history.

(56) References Cited

U.S. PATENT DOCUMENTS

| | | | |
|---|---|---|---|
| 2,560,433 | A | 7/1951 | Gilbert et al. |
| 2,600,931 | A | 6/1952 | Slater |
| 2,646,388 | A | 7/1953 | Crawford et al. |
| 2,755,225 | A | 7/1956 | Porter et al. |
| 2,771,401 | A | 11/1956 | Shepherd |
| 2,909,476 | A | 10/1959 | Hemminger |
| 2,912,375 | A | 11/1959 | MacLaren |
| 2,939,835 | A | 6/1960 | Varga et al. |
| 3,119,765 | A | 1/1964 | Corneil et al. |
| 3,180,820 | A | 4/1965 | Gleim et al. |
| 3,262,874 | A | 7/1966 | Gatsis |
| 3,501,396 | A | 3/1970 | Gatsis et al. |
| 3,617,524 | A | 11/1971 | Conn |

(Continued)

FOREIGN PATENT DOCUMENTS

| | | |
|---|---|---|
| AU | 8544833 A | 1/1986 |
| BE | 894513 | 1/1983 |

(Continued)

OTHER PUBLICATIONS

Parkash, Surinder (2003). Refining Processes Handbook (pp. 18-20). Elsevier.*

(Continued)

*Primary Examiner* — Renee E Robinson
(74) *Attorney, Agent, or Firm* — Bracewell & Giuliani LLP; Constance Gall Rhebergen; Bran Y Chin

(57) ABSTRACT

The present invention relates to a process for the treatment of heavy oils using a catalytic hydrotreating process. More specifically, the invention relates to the presence of light hydrocarbon components in conjunction with the heavy oils for improved treatment of the heavy oils utilizing moderate temperature and pressure.

12 Claims, 7 Drawing Sheets

(56) References Cited

U.S. PATENT DOCUMENTS

| | | | |
|---|---|---|---|
| 3,623,974 | A | 11/1971 | Mounce |
| 3,684,688 | A | 8/1972 | Roselius |
| 3,686,093 | A | 8/1972 | Irvine |
| 3,694,351 | A | 9/1972 | White |
| 3,706,657 | A | 12/1972 | Paraskos et al. |
| 3,730,879 | A | 5/1973 | Christman et al. |
| 3,730,880 | A | 5/1973 | Van der Toorn et al. |
| 3,787,315 | A | 1/1974 | Bearden, Jr. et al. |
| 3,806,444 | A | 4/1974 | Crouch et al. |
| 3,809,491 | A | 5/1974 | Banyai |
| 3,809,644 | A | 5/1974 | Johnson et al. |
| 3,826,737 | A | 7/1974 | Pegels et al. |
| 3,876,530 | A | 4/1975 | Frayer et al. |
| 3,876,533 | A | 4/1975 | Myers |
| 3,887,455 | A | 6/1975 | Hamner et al. |
| 3,901,792 | A | 8/1975 | Wolk et al. |
| 3,915,841 | A | 10/1975 | Murphy, Jr. et al. |
| 3,926,784 | A | 12/1975 | Christman et al. |
| 3,957,622 | A | 5/1976 | Gatsis et al. |
| 3,976,559 | A | 8/1976 | Bearden, Jr. et al. |
| 4,003,823 | A | 1/1977 | Baird, Jr. et al. |
| 4,003,824 | A | 1/1977 | Baird, Jr. et al. |
| 4,006,076 | A | 2/1977 | Christensen et al. |
| 4,007,109 | A | 2/1977 | Baird, Jr. et al. |
| 4,007,111 | A | 2/1977 | Baird, Jr. |
| 4,017,381 | A | 4/1977 | Baird, Jr. et al. |
| 4,017,382 | A | 4/1977 | Bonnell et al. |
| 4,045,182 | A | 8/1977 | Bonnell |
| 4,045,331 | A | 8/1977 | Ward |
| 4,048,060 | A | 9/1977 | Riley |
| 4,052,295 | A | 10/1977 | Pronk |
| 4,076,613 | A | 2/1978 | Bearden, Jr. |
| 4,089,774 | A | 5/1978 | Oleck et al. |
| 4,118,310 | A | 10/1978 | Frayer et al. |
| 4,119,528 | A | 10/1978 | Baird, Jr. et al. |
| 4,120,779 | A | 10/1978 | Baird, Jr. et al. |
| 4,120,780 | A | 10/1978 | Morimoto et al. |
| 4,234,402 | A | 11/1980 | Kirkbride |
| 4,259,294 | A | 3/1981 | Van Zijll Langhout et al. |
| 4,332,671 | A | 6/1982 | Boyer |
| 4,348,270 | A | 9/1982 | Bearden, Jr. et al. |
| 4,406,777 | A | 9/1983 | Melconian |
| 4,411,768 | A | 10/1983 | Unger et al. |
| 4,431,525 | A | 2/1984 | Hensley, Jr. et al. |
| 4,431,526 | A | 2/1984 | Simpson et al. |
| 4,568,450 | A | 2/1986 | Ting et al. |
| 4,588,709 | A | 5/1986 | Morales et al. |
| 4,617,110 | A | 10/1986 | Hinojos et al. |
| 4,619,759 | A | 10/1986 | Myers et al. |
| 4,626,340 | A | 12/1986 | Galiasso et al. |
| 4,642,179 | A | 2/1987 | Morales et al. |
| 4,652,361 | A | 3/1987 | Kukes et al. |
| 4,657,665 | A | 4/1987 | Beaton et al. |
| 4,729,826 | A | 3/1988 | Lindsay et al. |
| 4,832,829 | A | 5/1989 | de Agudelo et al. |
| 4,894,144 | A | 1/1990 | Newman et al. |
| 4,925,554 | A | 5/1990 | Sato et al. |
| 4,968,409 | A | 11/1990 | Smith |
| 5,009,768 | A | 4/1991 | Galiasso et al. |
| 5,045,177 | A | 9/1991 | Cooper et al. |
| 5,076,908 | A | 12/1991 | Strangeland et al. |
| 5,176,820 | A | 1/1993 | Lew |
| 5,178,749 | A | 1/1993 | Lopez et al. |
| 5,258,115 | A | 11/1993 | Heck et al. |
| 5,264,188 | A | 11/1993 | Lew |
| 5,417,846 | A | 5/1995 | Renard |
| 5,591,325 | A | 1/1997 | Higashi |
| 5,779,992 | A | 7/1998 | Higashi |
| 5,916,529 | A | 6/1999 | Scheuerman |
| 5,925,238 | A | 7/1999 | Duddy et al. |
| 6,132,597 | A | 10/2000 | Harle et al. |
| 6,235,190 | B1 | 5/2001 | Bertram |
| 6,270,654 | B1 | 8/2001 | Colyar et al. |
| 6,280,606 | B1 | 8/2001 | Morel et al. |
| 6,306,287 | B1 | 10/2001 | Billon et al. |
| 6,309,537 | B1 | 10/2001 | Harle et al. |
| 6,447,671 | B1 | 9/2002 | Morel et al. |
| 6,554,994 | B1 | 4/2003 | Reynolds et al. |
| 6,620,311 | B2 | 9/2003 | Morel et al. |
| 2001/0027936 | A1 | 10/2001 | Morel et al. |
| 2004/0055934 | A1 | 3/2004 | Tromeur et al. |
| 2005/0082202 | A1 | 4/2005 | Ackerson et al. |
| 2005/0155909 | A1 | 7/2005 | Inomata et al. |
| 2006/0060501 | A1 | 3/2006 | Gauthier et al. |
| 2006/0060509 | A1 | 3/2006 | Miyauchi et al. |
| 2006/0254956 | A1 | 11/2006 | Khan |
| 2007/0187294 | A1 | 8/2007 | Ancheyta Juarez et al. |

FOREIGN PATENT DOCUMENTS

| | | | |
|---|---|---|---|
| DE | 2138853 | A | 8/1974 |
| DE | 2655260 | A1 | 6/1977 |
| EP | 0113283 | B1 | 7/1984 |
| EP | 0113297 | B1 | 7/1984 |
| EP | 0450997 | B1 | 10/1991 |
| EP | 0732389 | B1 | 8/2001 |
| EP | 1600491 | A1 | 11/2005 |
| EP | 1652905 | A | 5/2006 |
| FR | 2415136 | A | 8/1979 |
| FR | 2681871 | A1 | 4/1993 |
| FR | 2784687 | A1 | 4/2000 |
| GB | 438354 | | 4/1934 |
| GB | 710342 | | 9/1950 |
| GB | 744159 | | 7/1953 |
| GB | 0721357 | | 1/1955 |
| GB | 830923 | | 3/1956 |
| GB | 786451 | | 11/1957 |
| GB | 1073728 | | 7/1964 |
| GB | 1181982 | | 6/1967 |
| GB | 1335348 | | 2/1970 |
| GB | 1523992 | | 9/1978 |
| GB | 2026533 | A | 2/1980 |
| GB | 2066287 | A | 7/1981 |
| GB | 2124252 | A | 2/1984 |
| GB | 2150852 | A | 12/1984 |
| JP | 71034507 | B | 7/1968 |
| JP | 49015703 | A | 2/1974 |
| JP | 49051303 | A | 5/1974 |
| JP | 74037085 | B | 10/1974 |
| JP | 48054105 | A | 10/1975 |
| JP | 76038722 | B | 10/1976 |
| JP | 60065093 | A | 4/1985 |
| JP | 2000265177 | A | 3/1999 |
| NL | 6916017 | A | 4/1970 |
| NL | 7213105 | | 9/1972 |
| NL | 7115994 | A | 9/1974 |
| NL | 7117302 | A | 10/1974 |
| RU | 2074883 | C1 | 3/1997 |
| WO | 0198436 | A1 | 12/2001 |
| WO | 2004078889 | A1 | 9/2004 |
| WO | 2006039429 | A | 4/2006 |
| WO | 20060114489 | A1 | 11/2006 |
| WO | 2009073436 | A2 | 6/2009 |

OTHER PUBLICATIONS

Ji, Shunfeng et al., "Determination of Hydrogen Solubility in Heavy Fractions of Crude Oils by a Modified Direct Method", Journal of Chemical & Engineering Data, vol. 58, Nov. 2013, pp. 3453-3457.*

Riazi, M.R. and Y.A. Roomi, "A method to predict solubility of hydrogen in hydrocarbons and their mixtures", Chemical Engineering Science, vol. 62, Aug. 2007, pp. 6649-6658.*

European Search Report issued in EP09790369.4, dated May 25, 2012 (6 pages).

H.-Y. Cai et al., "Hydrogen solubility measurements in heavy oil and bitumen cuts", Elsevier, fuel 80 (2001) 1055-1063 (9 pages).

* cited by examiner

Figure 2 Mechanism for Coke Formation
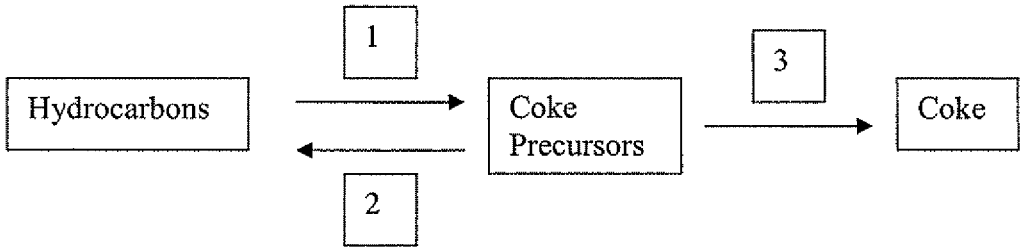

Figure 3 Hard Coke and Soft Coke Equilibrium
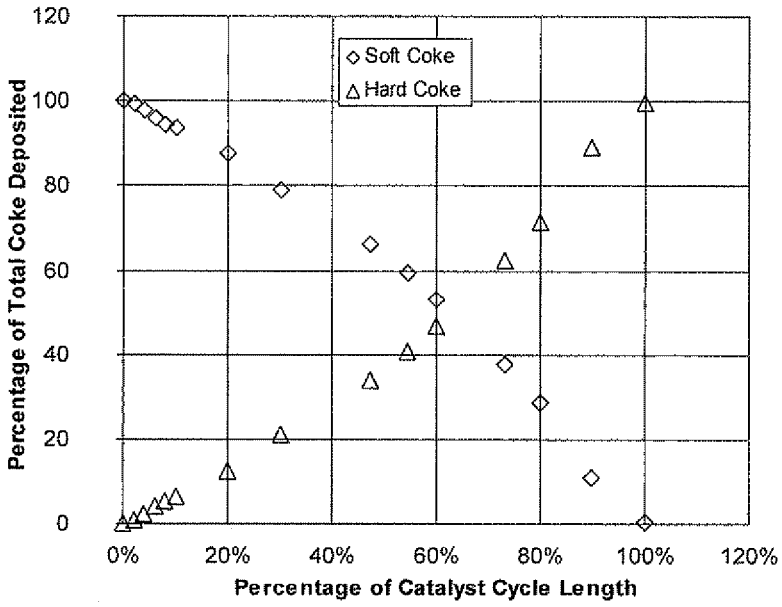
Figure 4 Simplified Representation of the Flux of Species Over a Catalyst Surface without Diluent
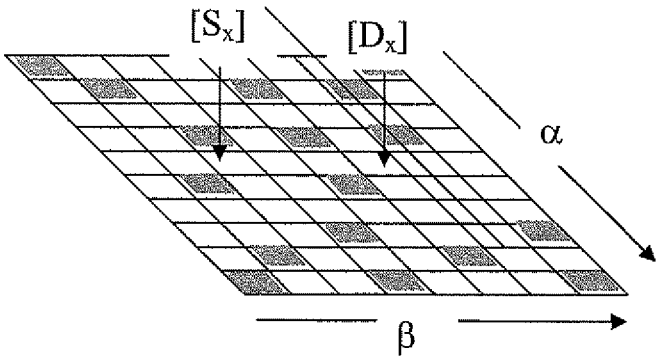

Figure 5 Simplified Representation of the Flux of Species Over a Catalyst Surface without Diluent
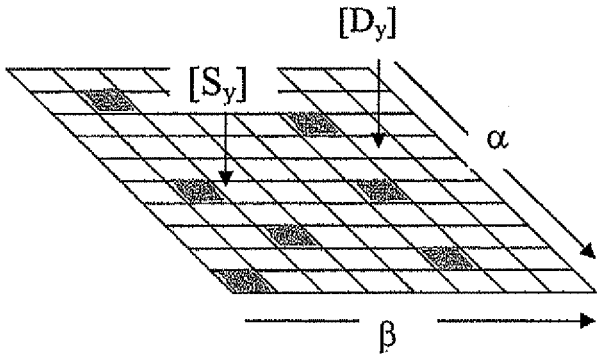

Figure 6 Predicted Cycle Length Based on Measured Deactivation Rate
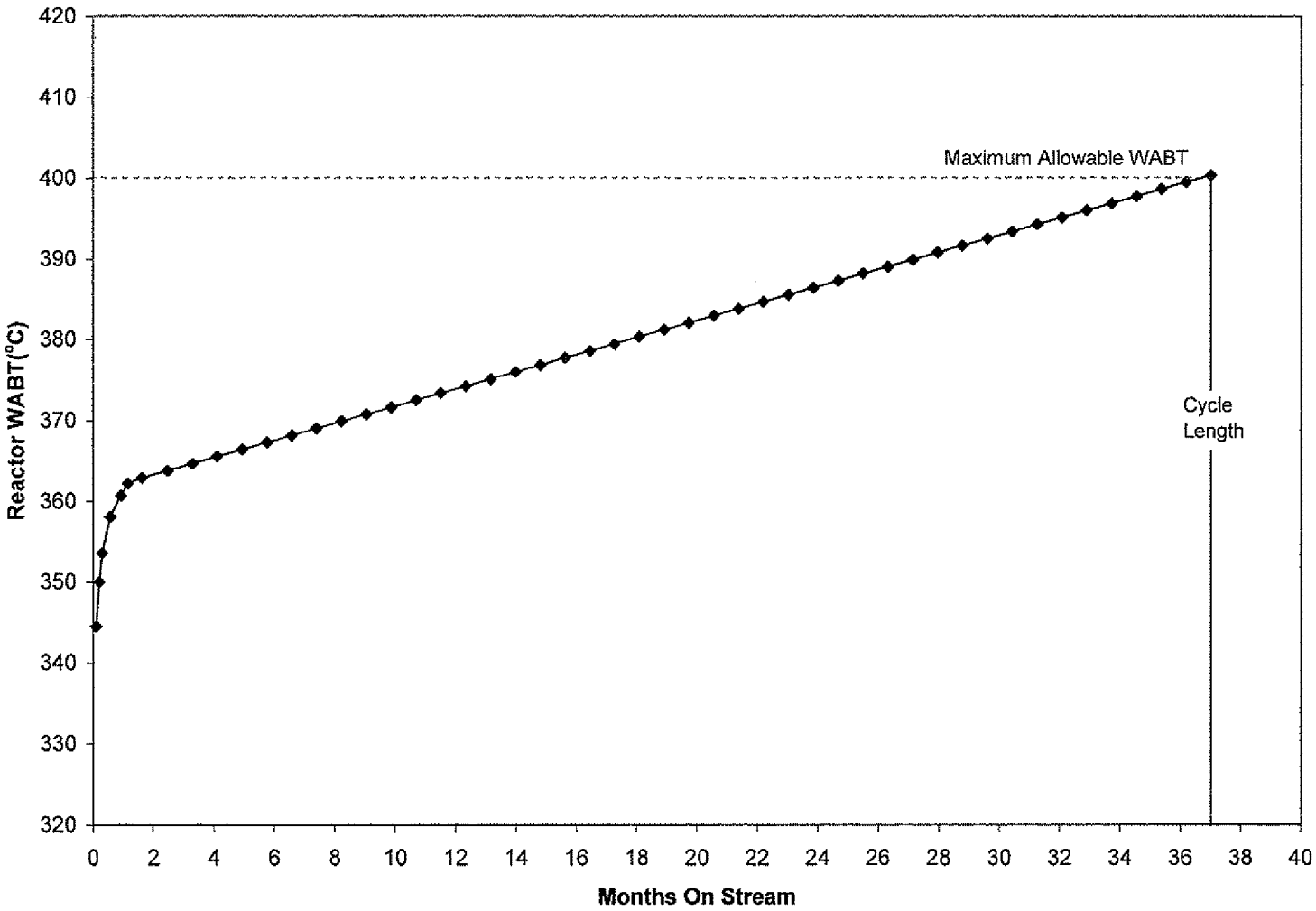

PROCESS FOR THE TREATMENT OF HEAVY OILS USING LIGHT HYDROCARBON COMPONENTS AS A DILUENT

RELATED APPLICATIONS

This patent application claims priority to U.S. Provisional Patent Application Ser. No. 61/080,517 filed on Jul. 14, 2008, which is incorporated by reference in its entirety.

BACKGROUND OF THE INVENTION

1. Field of the Invention

The present invention relates to a process for the treatment of heavy oils, including crude oils, vacuum residue, tar sands, bitumen and vacuum gas oils, using a catalytic hydrotreating process. More specifically, the invention relates to the use of catalysts in series in order to prolong the life of the catalyst. In another embodiment, the presence of light hydrocarbon components in conjunction with the heavy oils is used for improved treatment of the heavy oils utilizing moderate temperature and pressure.

2. Description of the Related Art

Hydrotreating is useful for the purpose of improving heavy oils. The improvement can be evidenced as the reduction of sulfur content of the heavy oil, an increase in the API gravity of the heavy oil, a significant reduction in the metal content of the heavy oil, or a combination of these effects.

The availability of light sweet crudes is expected to diminish in the future as the production of oil becomes increasingly difficult and greater reliance is placed on tertiary and enhanced recovery techniques. Heavier crudes and sour crudes will take on greater importance in overall hydrocarbon production and the upgrading of such crudes into fuels will become increasingly important. In addition to the decreasing quality of the crudes and their derived heavy oils, specifications for on-road and off-road fuel will become increasingly more stringent, driven by environmental legislation around the world. A greater emphasis on upgrading and degree of hydroprocessing can be expected in the refining industry.

One of the main limiting factors for hydroprocessing units is the deactivation of the hydroprocessing catalysts. As the heavy oil feedstock being treated becomes heavier, i.e. has a lower API Gravity, the complexity of the molecules increases. This increase in complexity is both in the molecular weight and also in the degree of unsaturated components. Both of these effects increase the coking tendency of the feedstock, which is one of the main mechanisms of deactivation of the catalyst. Another aspect of feedstock leading to deactivation of catalyst is metal content present in the heavy crude. These metals are normally present in the form of porphyrin type structures and they often contain nickel and/or vanadium, which have a significant deactivating effect on the catalyst. Similar to coking tendency, the metal concentration of the heavy oil feedstream increases with decreasing API gravity.

Any pre-refining of crude oil would provide a significant advantage for downstream process units.

As the refining industry increasingly processes higher sulfur, lower API crudes, catalyst deactivation will become a critical path problem, decreasing the on-stream cycle length and therefore increasing the cost of processing, negatively impacting process profitability. Advances in the treatment of heavy oil with respect to a reduction in catalyst deactivation will therefore be of paramount importance to the refining industry in future years.

Global diesel demand is forecasted to increase in the coming years due to the dieselization trend, equaling global demand for gasoline in the near future and surpassing this demand thereafter. A shift in product slate is occurring. The inherent content of the gas oil in crude oils is limited and conventional, expensive conversion techniques such as hydrocracking are required to increase the diesel yield by conversion. There is a need to provide a process for heavy oils that will increase diesel production in a cost-effective manner to meet market demands. There is a need to provide a process that minimizes capital expenditures necessary while meeting the product specifications.

SUMMARY OF THE INVENTION

The present invention describes a process for the upgrading of a heavy oil feed stream, examples of which include vacuum residue, whole crude oil, atmospheric residue and bitumen as well as other heavy oils. The process is useful for increasing the diesel content of crude oil. Reduced crudes are preferred, with atmospheric residue being particularly preferred. The process includes using a fixed or moving bed hydrotreatment process employing the use of a series of catalysts, a total hydrogen pressure of between 50 and 150 bar, a total Liquid Hourly Space Velocity, that is predetermined to correspond to the flow rates, of between about $0.1^{-1}$ to 5 $hr^{-1}$ and catalyst bed temperatures for the different catalysts at a moderate temperature of between 300 and 450° C.

The invention includes a process for upgrading of heavy oils. The steps of the invention include feeding the heavy oil feed stream to a hydrodemetalization reaction vessel that contains a hydrodemetalization catalyst. The hydrodemetalization catalyst is operable to remove a substantial quantity of metal compounds from the heavy oil feed stream. A hydrogen source is also fed to the hydrodemetalization reaction vessel. In a preferred embodiment, the hydrogen having a hydrogen pressure in the range of 50 to 150 bar. A light hydrocarbon diluent is also fed to the hydrodemetalization reaction vessel. While heavy oil feed stream, light hydrocarbon diluent and hydrogen source are all mixed together, the light hydrocarbon diluent and the unspent portion of the hydrogen source can be recovered from the process.

The heavy oil feed stream, hydrogen source and light hydrocarbon diluent together define a feed rate to the hydrodemetalization reaction vessel. In an additional embodiment, the feed rate further defines a total liquid hourly space velocity within a predetermined liquid hourly space velocity range of 0.1 to 2.0 $hr^{-1}$. A combined effluent stream is produced and removed from the hydrodemetalization reaction vessel with the combined effluent stream having a reduced amount of metals as compared to the metals in the heavy oil feed stream.

The invention further includes feeding the combined effluent stream to a hydrodesulfurization reaction vessel to produce a hydrodesulfurization catalyst effluent. The hydrodesulfurization reaction vessel containing a hydrodesulfurization catalyst operable to remove a substantial amount of sulfur from the combined effluent such that the hydrodesulfurization catalyst effluent contains substantially less sulfur as compared to the heavy oil feed stream.

The hydrodesulfurization catalyst effluent is fed to a hydroconversion reaction vessel to produce a hydroconverted product. The hydroconversion reaction vessel containing a hydroconversion catalyst that is operable to convert the hydrodesulfurization catalyst effluent to the hydroconverted product such that the hydroconverted product has an increased API gravity as compared to the heavy oil feed stream. This stream has an additionally higher increased diesel yield. An increased diesel yield is seen with the desulfurization, as evidenced in Table 2 and Table 4 below and as described in Chart 1. Passing through a hydroconversion zone provides yet additional increases.

The hydroconverted product is fed to a separation unit. The separation unit is operable to separate the hydroconverted product into a process gas component stream and a liquid product. The process gas component stream contains a substantial portion of unspent hydrogen from the hydrogen source. The liquid product is fed to a flash vessel to separate a light hydrocarbon fraction and a final liquid product. The final liquid product thus produced has a reduced sulfur content, reduced metal content and increased API gravity in comparison to the heavy oil feed stream.

In one embodiment of the invention, the process includes recycling at least a portion of the process gas component stream to the hydrodemetalization reactor vessel. In this manner, the unspent hydrogen recovered from the hydrogen source is used again. Another embodiment includes recycling at least a portion of the light hydrocarbon fraction to the hydrodemetalization reactor vessel. In this manner, the light hydrocarbon diluent can be reused repeatedly to gain the benefits of the effect of the light hydrocarbon diluent while economically recycling the material. The light hydrocarbon diluent is substantially liquid.

In one embodiment, the separation unit is also operable to remove sulfur components from the hydroconverted product stream. This can advantageously be accomplished through the use of catalyst or through known methods of sulfur removal such as liquid-liquid absorption. In this manner, the separation unit can include one or more physical vessels to accomplish the desired separations.

For certain heavy oil feed streams, there is present within the heavy oil feed stream some quantity of light hydrocarbon diluent. This portion of light hydrocarbon diluent can be recovered in the present invention and recycled to the hydrodemetalization reactor vessel thereby reducing the amount of light hydrocarbon diluent that is to be provided by an external source. In one embodiment, continuous recovery of light hydrocarbon diluent from the process from the heavy oil feed stream allows a sufficient quantity to accumulate such that an external source of light hydrocarbon diluent is not needed in order to maintain the light hydrocarbon diluent in circulation using the process of the current invention.

BRIEF DESCRIPTION OF THE DRAWING

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

FIG. 2 shows a mechanism for coke formation.

FIG. 3 shows an exemplary catalyst cycle length.

FIG. 4 shows a simplified representation of the flux of species over a catalyst Surface without diluent.

FIG. 5 shows a simplified representation of the flux of species over a catalyst Surface with diluent.

FIG. 6 shows a predicted cycle length based on measured deactivation rate

DETAILED DESCRIPTION OF THE EXEMPLARY EMBODIMENTS

Figure 1A:
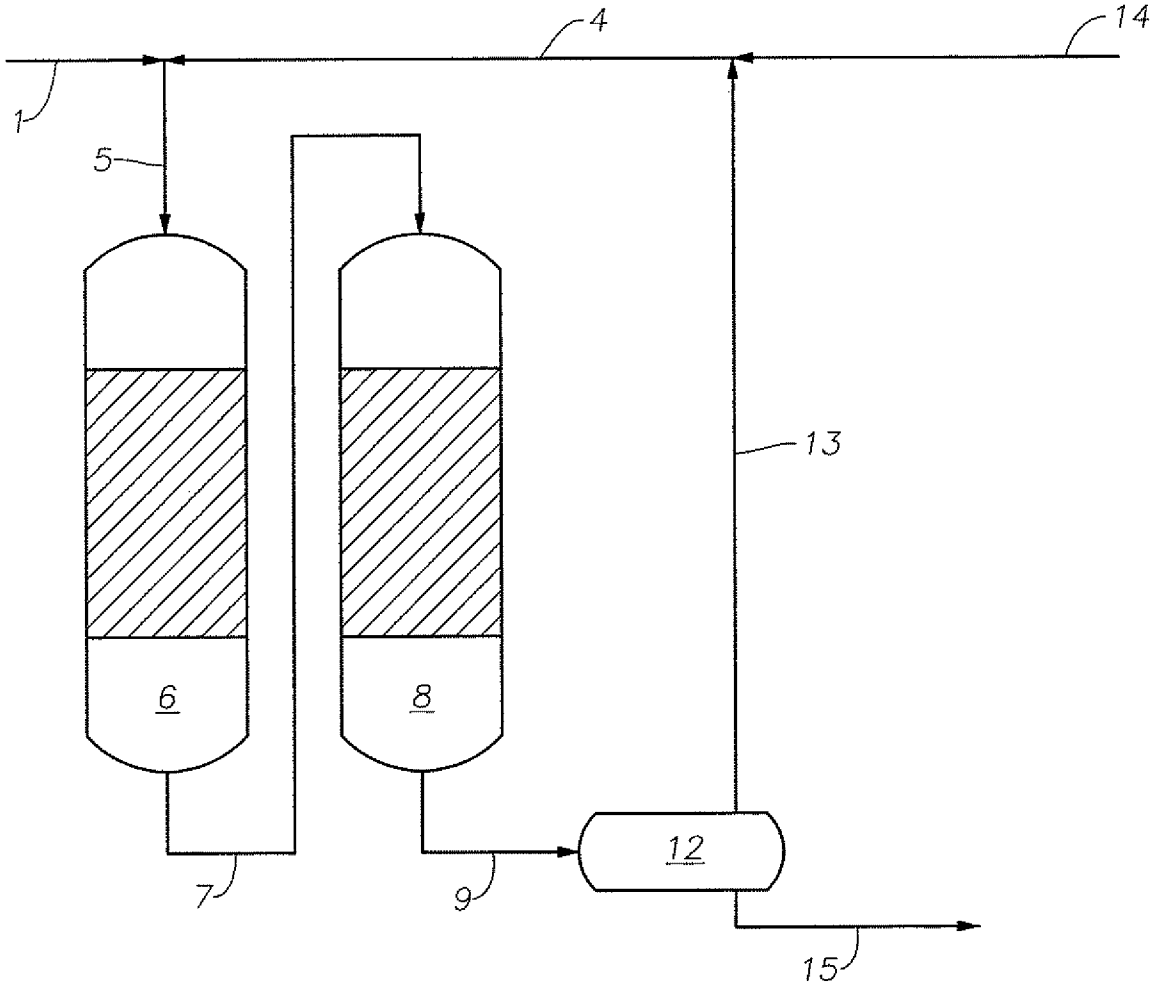
FIGS. 1A, 1B and 1C show preferred embodiments of the present invention.

FIG. 1A shows an exemplary embodiment of the current invention. In FIG. 1A, heavy oil feed stream (1) is mixed with hydrogen source (4). Hydrogen source (4) can be derived from recycle of process gas component stream (13), including unspent process hydrogen gas, and/or from fresh make-up hydrogen stream (14) to create first input stream (5). In one embodiment, first input stream (5) is heated to process temperature of between 350 and 450° C. The first input stream enters into hydrodemetalization reaction vessel (6), containing hydrodemetalization catalyst, to remove a substantial quantity of metal compounds present in the first input stream. Combined effluent stream (7) exits the hydrodemetalization reaction vessel and is fed to hydrodesulfurization reaction vessel (8) containing hydrodesulfurization catalyst to produce hydrodesulfurization effluent. A substantial mount of sulfur in the combined effluent stream is removed through hydrodesulfurization to produce hydrodesulfurization effluent (9). Hydrodesulfurization effluent (9) has an increased API gravity in comparison with heavy oil feed stream (1) and a significantly increased diesel content. The hydrodesulfurization effluent is separated into process gas component stream (13) and liquid product (15). In one embodiment, the hydrodesulfurization effluent is also purified to remove hydrogen sulfide and other process gases to increase the purity of the hydrogen to be recycled in the process gas component stream. The hydrogen consumed in the process is compensated for by the addition of a fresh hydrogen stream from hydrogen make-up stream (14), which can be derived from a steam or naphtha reformer or other source. The gas components and the hydrogen make-up stream combine to form hydrogen source (4) for the process. In one embodiment, the liquid product from the process is flashed in flash vessel (16) to separate light hydrocarbon fraction (17) and final liquid product (18). In one embodiment, light hydrocarbon fraction (17) acts as a recycle and is mixed with fresh light hydrocarbon diluent stream (2) to create light hydrocarbon diluent stream (3). Fresh light hydrocarbon diluent stream (2) can be used to provide make-up diluent to the process as needed. The final liquid product can be sent to a work up section of the process unit if desired. The final liquid product has significantly reduced sulfur, metal and nitrogen content as well as an increased API in comparison with the feed stream.

Without being bound to any theory, it is believe that during the hydrodemetalization reaction, porphyrin type compounds present in the feedstock are first hydrogenated by the catalyst using hydrogen to create an intermediate. Following this primary hydrogenation, the Nickel or Vanadium present in the center of the porphyrin molecule is reduced with hydrogen and then further to the corresponding sulfide with H2S. The final metal sulfide is deposited on the catalyst thus removing the metal sulfide from the hydrocarbon stream. Sulfur is also removed from sulfur containing organic compounds. This is performed through a parallel pathway. The rates of these parallel reactions depend upon the sulfur species being considered. Overall, hydrogen is used to abstract the sulfur which is converted to H2S in the process. The remaining, sulfur-free hydrocarbon fragment remains in the liquid hydrocarbon stream.

In a similar manner, and again not intending to be bound to any theory, hydrodenitrogenation and hydrodearomatisation operate via related reaction mechanisms. Both involve some degree of hydrogenation. For the hydrodenitrogenation, organic nitrogen compounds are usually in the form of heterocyclic structures, the heteroatom being nitrogen. These heterocyclic structures are saturated prior to the removal of the heteroatom of nitrogen. Similarly, hydrodearomatisation involves the saturation of aromatic rings. Each of these reactions occurs to a differing extent on each of the catalyst types as the catalysts are selective to favor one type of transfer over others and as the transfers are competing.

It is to be noted that one of the advantages obtained through the current invention is ability to create the upgraded product without the use of visbreaking techniques, thus avoiding the pre-treatment step and capital expenditure related thereto.

From Table 1 in Example 1 a typical feedstock treated by this process contains 72.8 ppmw of Nickel and Vanadium, 2200 ppmw of Nitrogen and 28927 ppmw of Sulfur. It can therefore be seen that the largest proportion of reactants for the above listed hydroprocessing reactions will be hydrodesulfurization. Some typical compounds which undergo hydrodesulfurization can be seen in Chart 1.

CHART 1

Molecular Weights and Boiling Points of Sulfur Compounds Desulfurized Analogues

| Sulfur Compound | Prior to Desulfurization | | Post Desulfurization Analogue | |
|---|---|---|---|---|
| | Molecular Weight | Boiling Point (° C.) | Molecular Weight | Boiling Point (° C.) |
| 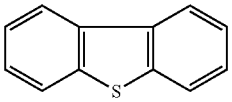 | 184.3 | 331.5 | 154.2 | 255 |
| 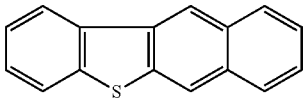 | 243.3 | 447.0 | 216.3 | 401.1 |

From Chart 1, it can be seen that hydrodesulfurization removes sulfur and also reduces the molecular weight of the molecule, the physical property with the dominant contribution to the boiling point. The first compound, dibenzothiophene, has a reduction in boiling point from 331° C. to 255° C. upon desulfurization. The second compound has a reduction in boiling point from 447° C. to 401° C. upon desulfurization. These changes in boiling point upon desulfurization are a driving force within the process of the invention, in which the whole crude oil is desulfurized thereby creating a change in the proportions of the products fractions. Sulfur molecules, which occur most often in heavier fractions such as vacuum gas oil, are desulfurized, thus reducing the molecular weight and therefore the boiling point. This desulfurized molecule will now be part of the diesel boiling range, as shown in the example below.

Example 1

Production of a Low Sulfur Crude Oil with Increased Diesel Yield

In one embodiment of the present invention an Arabian Heavy Crude Oil with properties as detailed in Table 1 was processed by the invention. Typical fractions, light naphtha, heavy naphtha, kerosene, diesel, vacuum gas oil and vacuum residue derived from both atmospheric and vacuum distillation of the Arabian Heavy Crude Oil can be seen in Table 2 along with the individual sulfur concentrations.

TABLE 1

Example 1, Bulk Properties of Arabian Heavy Export Crude Oil

| Analysis | Units | Value |
|---|---|---|
| Density at 15° C. | g/ml | 0.8904 |
| API Gravity | degree | 27.4 |
| CCR | wt % | 8.2 |
| Vanadium | wtppm | 54.6 |
| Nickel | wtppm | 16.4 |
| Sulphur | wt % | 2.8297 |

TABLE 2

Example 1, Yields of Individual Product Fractions and Sulfur Content from Arabian Heavy Export Crude Oil

| Fraction | Yield (wt %) | Sulfur (wt %) |
|---|---|---|
| $C_1$-$C_2$ | 0.2% | 0 |
| $C_3$-$C_4$ | 0.8 | 0 |
| Light Naphtha, $C_5$-85° C. | 4.6 | 0.0003 |
| Heavy Naphtha, 85-150° C. | 7.2 | 0.0118 |
| Kerosene, 150° C.-250° C. | 15.9 | 0.36 |
| Diesel, 250° C.-350° C. | 11.9 | 1.6829 |
| Vacuum Gas Oil, 350° C.-540° C. | 26.0 | 2.9455 |
| Vacuum Residue, 540° C.+ | 33.5 | 5.477 |
| Total Liquid Product, $C_5$+ | 99 | 2.855 |

The feedstock detailed in table 1 and the fractions detailed in table 2 were then subject to processing in a hydroprocessing pilot plant to achieve specific levels of Hydrodemetalization (HDM), hydrodesulfurization (HDS), hydrodenitrogenation (HDN) and hydrodearomatisation (HDA) reactions as follows.

The Arabian Heavy feedstock is first filtered prior to being mixed with hydrogen gas in a ratio of 640 Normal litters of hydrogen for each liter of Arab Heavy feedstock at a total pressure of 100 bar, regulated at the reactor outlet by means of a pressure control valve. The Arabian Heavy Feedstock and hydrogen mixture is fed to a reactor tube containing three catalysts loaded in the following order, one hydrodemetalization catalyst, one intermediate hydrodemetalization, hydrodesulfurization catalyst and one hydrodesulfurization catalyst, at a ratio of 1:2:7 respectively. These catalysts are loaded to a total catalyst volume of 1 liter, and are heated to a temperature of 370° C. The liquid and gas mixture is passed over the hot catalyst system at a liquid to catalyst ratio of 0.5 litters of liquid per liter of catalyst per hour and a gas to oil ratio of 800 litters of hydrogen gas per liter of feed per hour. During the contact between the gas, liquid and catalyst, the Hydrodemetalization (HDM), hydrodesulfurization (HDS), hydrodenitrogenation (HDN) and hydrodearomatisation (HDA) reactions take place, chemically transforming the Arab Heavy feedstock. During the process hydrogen is consumed and transformed into hydrogen sulfide and ammonia. In addition hydrogen is also consumed by other hydrocarbon fragments during side reactions such as carbon-carbon bond scission.

The products of the reaction are then analyzed in a similar fashion to that for the Arabian Heavy feedstock in Tables 1 and 2. The results of these can be seen in Tables 3 and 4.

TABLE 3

Example 1, Bulk Properties of the Desulfurized Crude Oil

| Analysis | Units | Value |
|---|---|---|
| Density at 15° C. | g/ml | 0.8741 |
| API Gravity | degree | 30.3 |
| CCR | wt % | 5.15 |
| Vanadium | wt ppm | 24.8 |
| Nickel | wt ppm | 10.2 |
| Sulphur | wt % | 0.5465 |

TABLE 4

Example 1, Yields of Individual Product Fractions and Sulfur Content from Desulfurized Crude Oil

| Fraction | Yield (wt %) | Sulfur (wt %) | Delta yield (wt %) |
|---|---|---|---|
| $C_1$-$C_2$ | 0.17% | 0 | −0.03 |
| $C_3$-$C_4$ | 0.92 | 0 | +0.12 |
| Light Naphtha, $C_5$-85° C. | 4.2 | 0 | −0.4 |
| Heavy Naphtha, 85-150° C. | 7.11 | 0 | −0.09 |
| Kerosene, 150° C.-250° C. | 15.44 | 0 | −0.46 |
| Diesel, 250° C.-350° C. | 17.62 | 0.0345 | +5.72 |
| Vacuum Gas Oil, 350° C.-540° C. | 29.86 | 0.1735 | +3.86 |
| Vacuum Residue, 540° C.+ | 24.67 | 1.7201 | −8.83 |
| Total Liquid Product, $C_5$+ | 98.9 | 0.55 | — |

Figure 1B:
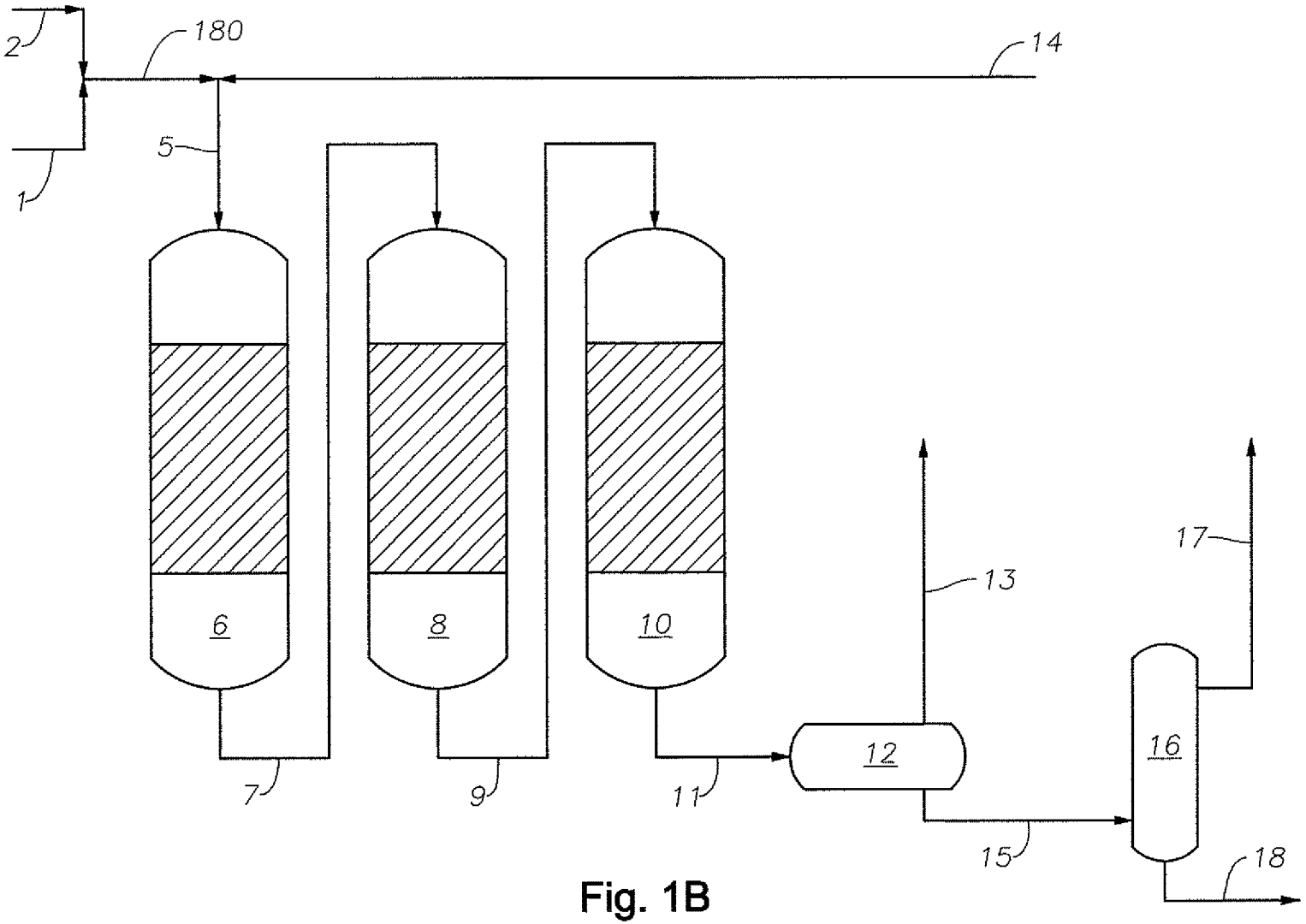
Figure 1C:
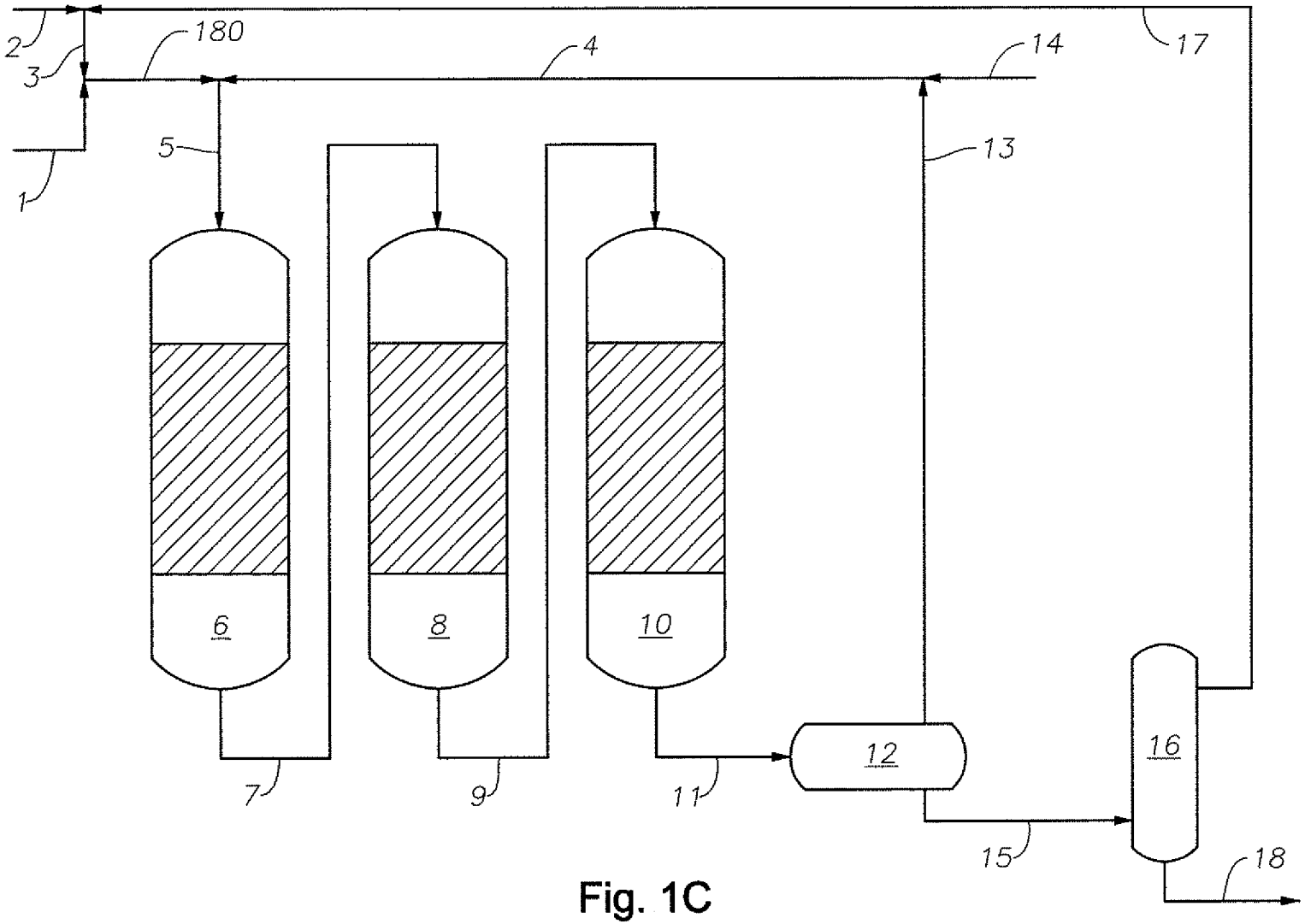

Advantageously, the use of the light hydrocarbon diluent in combination with the heavy oil feed stream for co-processing results in a reduction of the deactivation of all catalysts employed in the process. FIG. 1C shows one embodiment of the current invention. In FIG. 1C, heavy oil feed stream (1) is mixed with light hydrocarbon diluent stream (2) resulting in combined feed stream (180). The combined feed stream is then admixed with hydrogen source (4). Hydrogen source (4) can be provided from fresh make-up hydrogen stream. Alternately, as shown in FIG. 1C, Hydrogen source (4) can be derived from recycle of process gas component stream (13), including unspent process hydrogen gas, and from fresh make-up hydrogen stream (14) to create first input stream (5). In one embodiment, first input stream (5) is heated to process temperature of between 350 and 450° C. The first input stream enters into hydrodemetalization reaction vessel (6), containing hydrodemetalization catalyst, to remove a substantial quantity of metal compounds present in the first input stream. Combined effluent stream (7) exits the hydrodemetalization reaction vessel and is fed to hydrodesulfurization reaction vessel (8) containing hydrodesulfurization catalyst to produce hydrodesulfurization effluent. A substantial mount of sulfur in the combined effluent stream is removed through hydrodesulfurization to produce hydrodesulfurization effluent (9). Hydrodesulfurization effluent (9) from the hydrodesulfurization reaction vessel (8) is fed to hydroconversion reaction vessel (10), containing hydroconversion catalyst, where the hydrodesulfurization effluent is converted to hydroconverted product (11) having an increased API gravity in comparison with heavy oil feed stream (1). The hydroconverted product is separated into process gas component stream (13) and liquid product (15). In one embodiment, the hydroconverted product is also purified to remove hydrogen sulfide and other process gases to increase the purity of the hydrogen to be recycled in the process gas component stream. The hydrogen consumed in the process is compensated for by the addition of a fresh hydrogen stream from hydrogen make-up stream (14), which can be derived from a steam or naphtha reformer or other source. The gas components and the hydrogen make-up stream combine to form hydrogen source (4) for the process. In one embodiment, the liquid product from the process is flashed in flash vessel (16) to separate light hydrocarbon fraction (17) and final liquid product (18). In one embodiment shown in FIG. 1C, light hydrocarbon fraction (17) acts as a recycle and is mixed with fresh light hydrocarbon diluent stream (2) to create light hydrocarbon diluent stream (3). Fresh light hydrocarbon diluent stream (2) can be used to provide make-up diluent to the process as needed. The final liquid product can be sent to a work up section of the process unit if desired. The final liquid product has significantly reduced sulfur, metal and nitrogen content as well as an increased API in comparison with the feed stream.

As noted above, FIG. 1B shows heavy oil feed stream (1) co-processed through the addition of light hydrocarbon diluent. In one embodiment, light hydrocarbon diluent is provided in light hydrocarbon diluent stream (3). In another embodiment, at least a portion of the light hydrocarbon diluent is present in the feed stream. In an embodiment the portion of the light hydrocarbon diluent present in the feed stream is supplemented with an external source of light hydrocarbon diluent, such as fresh light hydrocarbon diluent (2), to create light hydrocarbon diluent stream (3). The combined feed stream (180) is admixed with hydrogen source (4) derived from recycle of unspent process hydrogen gas present in process gas component stream (13) and/or fresh make-up hydrogen stream (14) to create first input stream (5). The process advantageously can be operated at moderate temperatures, providing further benefits due to the avoidance of severe operating parameters typically experienced with catalytic processing. In one embodiment, first input stream is heated to process temperature of between 350 and 450° C. The first input stream enters into hydrodemetalization reaction vessel (6), containing hydrodemetalization catalyst, to remove a substantial quantity of metal compounds present in the first input stream.

Flow rate of the first input stream is controlled to achieve a predetermined total Liquid Hourly Space Velocity (LHSV). In one embodiment, a total Liquid Hourly Space Velocity of between about 0.1 $hr^{-1}$ to 5 $hr^{-1}$ In another embodiment, LHSV is preferably between about 0.1 $hr^{-1}$ and 2 $hr^{-1}$. The catalyst activity and selectivity can be substantially prolonged by reducing the LHSV to this range. Additionally, the diluent is believed to protect the catalyst and prolong its active life prior to regeneration.

Combined effluent stream (7) exits the hydrodemetalization reaction vessel (6) and is fed to hydrodesulfurization reaction vessel (8) containing hydrodesulfurization catalyst to produce hydrodesulfurization effluent. In one embodiment, at least 30% of the total sulfur in the combined effluent stream is removed through hydrodesulfurization to produce hydrodesulfurization effluent (9) thereby substantially reducing sulfur content. Hydrodesulfurization effluent (9) produced from the hydrodesulfurization reactor (8) is fed to hydroconversion reaction vessel (10), containing hydroconversion catalyst, where the hydrodesulfurization effluent is converted to product hydroconverted product (11) having an increased API gravity in comparison with the combined feed stream. In one embodiment, the API gravity is increased by at least one (1) degree as compared to the heavy oil feed stream. The hydroconverted product is separated into process gas component stream (13) and liquid product (15) through the use of separation unit (12). The separation unit can include one or more steps in one or more vessel. Exemplary techniques used in the separation unit include catalytic reduction of sulfur to further reduce hydrogen sulfide content in the process gas component stream and vapor-liquid separation. Other exemplary techniques include liquid redox reaction for hydrogen sulfide removal, amine treatment, chelating treatment and other methods known in the art. Similarly, other process gases can be separated through various equilibrium, absorption or known techniques resulting in high concentration of hydrogen in the process gas component stream. This allows hydrogen that is not consumed in the process to be recycled.

The hydrogen that is consumed in the process is compensated for by the addition of a fresh hydrogen stream from hydrogen make-up stream (14), which can preferably be derived from a steam or naphtha reformer. The gas components and the hydrogen make-up stream combine to form hydrogen source (4) for the process. In a preferred embodiment, the liquid product from the process is flashed in flash vessel (16) to separate a light hydrocarbon fraction (17) and final liquid product (18). Similarly, a series of flashes, a multi-stage separation vessel or the like can be used. In one embodiment, light hydrocarbon fraction (17) can be mixed with fresh light hydrocarbon diluent (2) as needed to create light hydrocarbon diluent stream (3), thus recycling diluent. In this manner, the light hydrocarbon diluent can be maintained largely within the closed system. Preferred light hydrocarbon diluents include compositions that are a mixture of hydrocarbons derived from crude oil and having a final boiling point equal or less than the initial boiling point of the diesel range or not having a final boiling point lower than the 30% point of the heavy oil feed stream. It is preferred that the light hydrocarbon diluent remain substantially in the liquid phase during the reactions. Preferably, light hydrocarbon diluent contains components that, if remaining in small quantities in the final liquid product, would not substantially alter the final liquid product. The recovery of the light hydrocarbon diluent for the purpose of recycling within the system is enhanced by the boiling point being lower than the initial boiling point of the heavy crude oil. The light hydrocarbon diluent enters the process substantially as liquid. An exemplary diluent would have an initial boiling point of around 250 degrees C.

The final liquid product can be sent to the work up section of the process unit as desired. The final liquid product has significantly reduced sulfur, metal and nitrogen content as well as an increased API in comparison with the feed stream.

Without being bound by theory, FIG. 2 demonstrates the scientific rational for the mechanism for coke formation under hydroprocessing conditions. Not intending to be bound by any theory, it is believed that the hydrocarbon reactants present in the feed undergo a dehydrogenation reaction [Reaction 1] on the catalyst surface to produce coke precursors. This produces unsaturated compounds that are present in an equilibrium concentration on the catalyst. The equilibrium concentration is maintained by the forward reaction [Reaction 1] and depleted by a backward hydrogenation reaction [Reaction 2]. In addition, the preformed coke precursors can undergo condensation reactions [Reaction 3] to form higher molecular weight coke compounds which are irreversibly present on the catalyst surface. These compounds negatively impact the activity of the catalyst by blocking the active sites responsible for the reaction.

The coke is present in two forms, termed Hard Coke and Soft Coke. Soft Coke is formed initially on the catalyst surface and, during the course of the on-stream lifetime of the catalyst on a commercial unit, the Soft Coke is turned to Hard Coke. Hard coke cannot be removed from the catalyst surface except when the catalyst is regenerated either in situ or ex situ by means of a carbon burn, also termed regeneration. FIG. 3 shows the equilibrium levels of Hard and Soft Coke on a typical catalyst surface In summary this equilibrium shows that as the on stream age of the catalyst surface increases, i.e. the one increases the percentage of the catalyst cycle length, the percentage of the total coke being deposited on the catalyst surface is increasingly made up of Hard Coke moieties. In addition to this the total coke deposited on the catalyst surface will increase during the on stream catalyst lifetime.

It is believed that the present invention reduces the rate of coke formation by modifying the rate of formation of the coke precursors. This achieved by reducing the concentration of the hydrocarbons which can form coke precursors in Reaction 1. For the particular case of this explanation the catalyst surface is represented theoretically, in FIG. 4, by the cross sectional surface of area alpha×beta. This is a simplified view of a catalyst surface. The squares on this surface represent the active catalysts sites. The concentration of species undergoing reaction on the catalyst surface is represented by [Sx]. These represent the concentration of the compounds that undergo, in this case, hydroprocessing reactions. The species which cause deactivation through coking are represented as having a certain concentration [Dy]. The resulting sites which undergo coking are represented by the grey squares.

As described above, light hydrocarbon diluent is used along with the heavy oil feed stream, in the form of added light hydrocarbon diluent or light hydrocarbon diluent present in the heavy oil feed stream within the feedstock itself. The effect of this diluent will therefore be to reduce the concentrations of both the reacting species S and D and the deactivating species such that $$[Sx]>>[Sy,] \text{ and } [Dx]>>[Dy_{y,}]$$

As the concentration of the deactivating species is lower, the rate of formation of coke is therefore significantly reduced by the effect of using the diluent. This makes the on stream catalyst life significantly longer by reducing the flux of the deactivating species per unit area of catalyst surface. As can be seen from the comparison the resulting benefit is that a lower number of sites are deactivated in this case using the process of the current invention.

Preferably, the light hydrocarbon diluent is present at a ratio of at least 5 weight percent compared to the heavy oil feed stream. Increasing this ratio continues to provide advantages in suppression of the formation of hard coke, but can also increase vessel size and other parameters. The preferred light hydrocarbon diluents should contain less than or equal to about 30% aromatics and should have a final boiling point less than or equal to about 335 degrees C. More preferably, final boiling points of less than or equal to 320 degrees C. will assist in avoiding polynuclear aromatics being entrained onto the catalyst, thus prolonging catalyst life. Preferably, the combined heteroatom content for the light hydrocarbon diluent should not exceed more than approximately 3 wt % on a weight per weight diluent basis.

Characteristics and composition of a preferred light hydrocarbon diluent include light hydrocarbons such as C15-C25 alkyl hydrocarbons. The light hydrocarbon diluent preferably contains no more than 30% aromatics When pure compounds are used, then non polar compounds are preferred with no heteroatom and no functionality apart from the hydrocarbon skeleton. The light hydrocarbon diluent is preferably substantially liquid when in contact with the catalyst.

Example 2

Production of a Low Sulfur Crude Oil

In one embodiment of the present invention an Arabian Heavy Crude Oil with properties as detailed in Table 1 was hydroprocessed. In this example no external diluent was required, the lighter fraction of the crude oil demonstrates the required performance advantage by diluting the heavily deactivating species in the vacuum residue fraction. Through the process of the invention, the light hydrocarbon diluent, also called the lighter fraction of the crude oil, is separated and recycled into the process until a predetermined ratio of light hydrocarbon diluent to heavy oil feed stream is acquired. The properties of the obtained sweetened crude oil can be seen in Table 2. The sweetened crude oil was obtained in a fixed bed reactor at a total pressure of 100 bar, liquid hourly space velocity of 0.5 hr−1 and hydrogen to hydrocarbon ratio of 1000 N1/1.

The catalyst used in the hydrodesulfurization reaction vessel was NiMoAl2O3. The catalyst used in the hydrodemetalization reaction vessel was NiMoAl2O3. The catalyst used in the hydroconversion reaction vessel was NiW/Al2O3/SiO2. Other catalysts known in the art for these purposes are also effective. The ratio of light hydrocarbon diluents to heavy crude oil while at steady state was 10 wt %. A preferred range of circulation rates is light hydrocarbon diluent to be between 5 wt % and 20 wt % of the fresh feed for reduced crudes.

TABLE 1

Example 2, An Example of a Typical Feedstock to be Desulfurized by the Process

| Crude Origin | Units | Arabian Heavy Export |
|---|---|---|
| Refractive index | | 1.5041 |
| Density at 15° C. | g/ml | 0.8904 |
| API Gravity | ° | 27 |
| CCR | wt % | 8.2 |
| 550° C. + Vacuum Residue | Wt % | 30 |
| Vanadium | wt ppm | 56.4 |
| Nickel | wt ppm | 16.4 |
| Sulphur | wt % | 2.8297 |
| NaCl content | wt ppm | <5 |
| C | wt % | 84.9 |
| H | wt % | 11.89 |

TABLE 1-continued

Example 2, An Example of a Typical Feedstock to be Desulfurized by the Process

| Crude Origin | Units | Arabian Heavy Export |
|---|---|---|
| O | wt % | 0.43 |
| N | wt % | 0.22 |
| S | wt % | 2.71 |

TABLE 2

Example 2, Properties of Synthetic Crude Produced

| Crude Origin | Units | Synthetic Crude Oil Produced |
|---|---|---|
| Refractive index | | 1.4948 |
| Density at 15° C. | g/ml | 0.8762 |
| API Gravity | ° | 29.9 |
| CCR | wt % | — |
| Vanadium | wt ppm | 23.4 |
| Nickel | wt ppm | 8.7 |
| Sulphur | wt % | 0.5547 |
| NaCl content | wt ppm | — |

As can be seen from the Table 1, around 30 wt % of the Arabian Heavy is vacuum residue, containing very high metals content and highly deactivating complex aromatics species. In effect, this vacuum residue can be treated in this manner using the lighter material present in the Arabian Heavy as the light hydrocarbon diluent. The resulting deactivation rate for the production of this reduced sulfur crude oil is very low, much lower than seen with heavy fractions such as those seen with vacuum residue hydroprocessing. Typical vacuum deactivation rates observed in residue hydrotreating are in excess of 3° C. month for an equivalent volume for volume comparison to the present example. For the current example an average of 1° C./month deactivation was observed, significantly lower than calculated based on the vacuum residue fraction alone.

In the current invention, API of the heavy oil feed stream is increased by greater than 1°.

FIG. 6 show the predicted cycle length for the present example, that being the production of a low sulfur crude oil.

One benefit of the current invention is demonstrated in the comparison with analogous processing where the light hydrocarbon diluent is not present. The table below shows two processes and the evolution of their relative performances. The first is industry data representative of a commercial atmospheric residue hydrotreater. Here one can see that 5C of catalyst activity is lost per month when achieving a desulfurization to 0.3 wt %. When one compares the current invention, it can clearly be seen that the deactivation rate is strikingly lower than one would expect. It should be noted that the overall LHSV for this invention is 0.5 hr−1, the LHSV shown is for the atmospheric residue fraction only.

| Source | Feedstock | Start of Run Catalyst Temp | End of Run Catalyst Temp (8 months) | Sulfur Content (AR Basis) | Deactivation Rate | Space Velocity (AR Basis) |
|---|---|---|---|---|---|---|
| Industry Data | Atmospheric Residue | 385° C. | 425° C. | 0.3 wt % | 5° C./mo | 0.25 $hr^{-1}$ |
| Current Invention | Arab Heavy Crude Oil | 370° C. | 380° C. | 0.95 wt % | 1.25° C./mo | 0.25 $hr^{-1}$ |

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims. The singular forms "a", "an" and "the" include plural referents, unless the context clearly dictates otherwise. By way of example, the term "a vessel" includes one or more vessels used for the stated purpose.

What is claimed is:

1. A process for upgrading of heavy oils comprising the steps of:

feeding a heavy oil feed stream to a hydrodemetalization reaction vessel, the hydrodemetalization reaction vessel containing a hydrodemetalization catalyst, the hydrodemetalization catalyst being operable to remove a substantial quantity of metal compounds from the heavy oil feed stream;

feeding a hydrogen source to the hydrodemetalization reaction vessel, the hydrogen source having a hydrogen pressure in the range of 50 to 150 bar; and feeding a light hydrocarbon diluent to the hydrodemetalization reaction vessel, the light hydrocarbon diluent being substantially in liquid phase, wherein the feeding of the heavy oil feed stream and the hydrogen source and the light hydrocarbon diluent to the hydrodemetalization reaction vessel defines a feed rate, the feed rate further defining a total liquid hourly space velocity within a predetermined liquid hourly space velocity range of 0.1 $hr^{-1}$ to 5 $hr^{-1}$ such that a combined effluent stream is produced and removed from the hydrodemetalization reaction vessel;

the process further comprising;

feeding the combined effluent stream to a hydrodesulfurization reaction vessel, the hydrodesulfurization reaction vessel containing a hydrodesulfurization catalyst operable to remove a substantial amount of sulfur from the combined effluent such that a hydrodesulfurization catalyst effluent is produced;

feeding the hydrodesulfurization catalyst effluent to a hydroconversion reaction vessel, the hydroconversion reaction vessel containing a hydroconversion catalyst, the hydroconversion catalyst being operable to convert the hydrodesulfurization catalyst effluent to a hydroconverted product, the hydroconverted product having, an increased API gravity as compared to the heavy oil feed stream;

feeding the hydroconverted product to a separation unit, the separation unit operable to separate the hydroconverted product into a process gas component stream and a liquid product;

feeding the liquid product to a flash vessel to separate a light hydrocarbon fraction and a final liquid product, the final liquid product having a reduced sulfur content, reduced metal content and increased API gravity in comparison to the heavy oil feed stream;

recycling at least a portion of the light hydrocarbon fraction to the hydrodemetalization reaction vessel; and combining the recycled light hydrocarbon fraction with a fresh light hydrocarbon diluent to form the light hydrocarbon diluent and to thereby recycle the light hydrocarbon diluent to the hydrodemetalization reaction vessel to reduce coke formation.

2. The process of claim 1, further comprising the step of:

recycling at least a portion of the process gas component stream to the hydrodemetalization reaction vessel.

3. The process of claim 1 wherein the separation unit is operable to remove sulfur components from the hydroconverted product.

4. The process of claim 1 wherein the sulphur removed, from the heavy feed oil stream in the hydrodesulfurization reaction vessel is at least 30 wt % of sulphur found in the heavy oil feed stream.

5. The process of claim 1 wherein the light hydrocarbon diluent is a mixture of hydrocarbons derived from crude oil and defining a final boiling point, the heavy oil feed stream further defines an initial boiling point, and the final boiling point of the light hydrocarbon diluent does not exceed the initial boiling point of the heavy oil feed stream.

6. The process of claim 1 wherein at least a portion of the light hydrocarbon fraction is added to the heavy oil feed stream.

7. The process of claim 1 wherein the light hydrocarbon diluent is present at a ratio of at least 5 wt % compared to the heavy oil feed stream.

8. The process of claim 1 wherein the light hydrocarbon diluent comprises light hydrocarbons selected from the group consisting of $C_{15}$-$C_{25}$ alkyl hydrocarbons.

9. The process of claim 1 wherein the light hydrocarbon diluent comprises less than about 30 wt % aromatics and has a final boiling point less than about 335° C.

10. The process of claim 1 wherein a ratio of the light hydrocarbon diluent to heavy crude oil in the heavy oil feed stream, while the process is at steady state, is 10 wt %, and a circulation rate of the light hydrocarbon diluent is between 5 wt % to 20 wt % of a feed of the fresh light hydrocarbon diluent for reduced crudes.

11. The process of claim 1, wherein an average deactivation rate of hydroprocessing catalysts for the production of reduced sulfur crude oil is 1° C. per month.

12. A process for upgrading of heavy oils to increase diesel comprising the steps of:

feeding a heavy oil feed stream to a hydrodemetalization reaction vessel, the hydrodemetalization reaction vessel containing a hydrodemetalization catalyst, the hydrodemetalization catalyst being operable to remove a substantial quantity of metal compounds from the heavy oil feed stream;

feeding a hydrogen source to the hydrodemetalization reaction vessel, the hydrogen source having a hydrogen pressure in the range of 50 to 150 bar; and feeding a light hydrocarbon diluent to the hydrodemetalization reaction vessel wherein the feeding of the heavy oil feed stream and the hydrogen source and the light hydrocarbon diluent to the hydrodemetalization reaction vessel defines a feed rate, the feed rate further defining a total liquid hourly space velocity within a predetermined liquid hourly space velocity range of 0.1 $hr^{-1}$ to 5 $hr^{-1}$ that a combined, effluent stream is produced and removed from the hydrodemetalization reaction vessel;

the method further comprising:

feeding the combined effluent stream to a hydrodesulfurization reaction vessel, the hydrodesulfurization reaction vessel containing a hydrodesulfurization catalyst operable to remove a substantial amount of sulfur from the combined effluent such that a hydrodesulfurization catalyst effluent is produced;

feeding the hydrodesulfurization catalyst effluent to a separation unit, the separation unit operable to separate the hydrodesulfurization catalyst effluent into a process gas component stream and a liquid product;

recycling at least a portion of the gas component stream to the hydrodemetalization reaction vessel;

feeding the liquid product to a flash vessel to separate a light hydrocarbon fraction and a final liquid product, the final liquid product having a higher diesel content as compared to the heavy oil feed stream;

recycling at least a portion of the light hydrocarbon fraction to the hydrodemetalization reaction vessel; and combining the recycled light hydrocarbon fraction with a fresh light hydrocarbon diluent to form the light hydrocarbon diluent and to thereby recycle the light hydrocarbon diluent to the hydrodemetalization reaction vessel to reduce coke formation.

* * * * *

UNITED STATES PATENT AND TRADEMARK OFFICE

CERTIFICATE OF CORRECTION

PATENT NO. : 9,260,671 B2
APPLICATION NO. : 12/502357
DATED : February 16, 2016
INVENTOR(S) : Raheel Shafi et al.

It is certified that error appears in the above-identified patent and that said Letters Patent is hereby corrected as shown below:

In the claims

In Column 13, Line 49, Claim 1, the last word appears as "comprising;" and should read --comprising:--.

In Column 13, Line 61, Claim 1, the second to last word appears as "having," and should read --having--.

In Column 14, Line 31, Claim 4, the last word appears as "removed," and should read --removed--.

In Column 15, Line 15, Claim 12, the last three words appear as "that a combined," and should read --such that a combined--.

Signed and Sealed this
Tenth Day of May, 2016

Michelle K. Lee

Michelle K. Lee
*Director of the United States Patent and Trademark Office*